United States Patent [19]

Sickles

[11] 4,343,433

[45] Aug. 10, 1982

[54] INTERNAL-ATOMIZING SPRAY HEAD WITH SECONDARY ANNULUS SUITABLE FOR USE WITH INDUCTION CHARGING ELECTRODE

[75] Inventor: James E. Sickles, Glenshaw, Pa.

[73] Assignee: PPG Industries, Inc., Pittsburgh, Pa.

[21] Appl. No.: 41,663

[22] Filed: May 23, 1979

Related U.S. Application Data

[63] Continuation-in-part of Ser. No. 837,797, Sep. 29, 1977, abandoned.

[51] Int. Cl.[3] ..... B05B 5/02

[52] U.S. Cl. ..... 239/3; 239/300; 239/414

[58] Field of Search ..... 239/707, 3, 414, 416, 239/300, 416.1, 416.4, 424.5, 434.5, 690, 706

[56] References Cited

U.S. PATENT DOCUMENTS

| | | | |
|---|---|---|---|
| 1,661,150 | 2/1928 | Birkenmaier | 239/527 X |
| 2,029,423 | 2/1936 | Gustafsson | 239/300 X |
| 2,042,746 | 6/1936 | Tracy | 239/300 X |
| 2,214,035 | 9/1940 | Tracy | 239/526 X |
| 2,569,251 | 9/1951 | Nieburg | 239/141 |
| 3,589,607 | 6/1971 | Wolf et al. | 239/705 |

FOREIGN PATENT DOCUMENTS

| | | | |
|---|---|---|---|
| 387744 | 6/1973 | U.S.S.R. | 239/300 X |

*Primary Examiner*—Robert B. Reeves
*Assistant Examiner*—Gene A. Church
*Attorney, Agent, or Firm*—Godfried R. Akorli; George D. Morris

[57] ABSTRACT

A spray head for use with conventional air-atomizing spray equipment is disclosed which has spray-forming means that includes a secondary atomization annulus which provides improved atomization of liquid materials and which is especially suitable for spray devices having electrostatic induction charging means. The secondry annulus minimizes deposition on the spray head of particles electrically charged with a polarity opposite that of components of the spray head and provides re-atomization of sprayable material which collects on the walls of the nozzle.

12 Claims, 3 Drawing Figures

INTERNAL-ATOMIZING SPRAY HEAD WITH SECONDARY ANNULUS SUITABLE FOR USE WITH INDUCTION CHARGING ELECTRODE

BACKGROUND OF THE INVENTION

This application is a continuation-in-part of copending application Ser. No. 837,797, filed Sept. 29, 1977, now abandoned.

This invention relates to spraying equipment and more particularly to improvements in spray-forming nozzles which provide enhanced atomization of liquid materials, especially those atomized materials which are electrostatically charged before deposition on a target substrate.

The deposition of film-forming materials by spraying processes provides evenly applied coatings having exceptional gloss properties not usually achievable with mechanical coating processes, such as brushing, dipping, rolling, or with electrical processes such as electrodeposition. Spray deposition also provides a mechanism for distributing materials on substrates which have irregular or relatively inaccessible surface configurations, and is thus particularly suitable for applying agriculture pest control materials to leafy plants, trees and the like.

Achieving even application of film-forming coating materials and pest control agents depends firstly upon proper formation of the material or agent into particles by a spray device, and then upon uniform distribution of the particles onto the target substrate. The formation of particles, in the case of liquid materials, is usually by atomization of the liquid as the liquid is mixed with a gas, usually air. Liquid particles atomization for spray deposition is generally achieved in one of three ways, by mixing streams of liquid and air moving at high velocity, by the shearing of a low velocity liquid stream with a high velocity stream of air, and by thrusting a high velocity stream of liquid material into contact with an essentially quiescent ambient atmosphere.

Proper atomization of liquids is generally measured by two parameters—particle size or fineness of the particles, and particle uniformity, that is, the number of particles of a unit sample which approximate a given size. It is generally desirable that particles be formed of relatively small mean diameter, though a lower limit of particle size does exist where air entrainment of the very small particles becomes a significant and detrimental problem resulting in reduced deposition efficiency. It is almost always desirable, whatever the particle size of a sample, that there be a narrow range of particle sizes around a mean particle diameter.

Uniform distribution of properly atomized particles of a liquid material upon a target substrate is the second important factor in achieving an evenly applied coating. In spray applying a film-forming decorative or protective coating material, the particles must be distributed evenly and uniformly upon a substrate to allow coalescence and levelling of the particles into a film of uniform thickness and gloss without such undesirable characteristics as sagging or spotting while wet, or cracking or blistering after drying. In spray applying pest control agents, uniformity of distribution of particles is of utmost importance in maximizing protection of crops while maintaining a safe environment for humans and animals while simultaneously minimizing costs of the pest control agent.

Both particle fineness and uniformity of particle size are often quite difficult to achieve with conventional spray devices, either of the "internal" or "external" mixing types. The terms "internal-atomizing" or "internal-mixing" characterize a nozzle which achieves atomization within the confines of the nozzle walls; "external-atomizing" characterizes a nozzle providing atomization outside the nozzle walls. Generally preferred atomizing devices, especially for spraying film-forming coating materials, include internal-mixing nozzles, since a nozzle of this type forms a spray stream more narrowly confined than that formed by an external-mix type. A narrowly diverging spray stream when used, for example, to apply coating materials in a confined space, such as the interiors of refrigerators, ovens and small containers, offers less "blow-back" of sprayed material toward the spraying device and thus provides higher spraying efficiency. An internal mix device has the further advantage of requiring a smaller quantity of air to achieve fine atomization of a given quantity of liquid than does an external mix device since formation of the spray stream takes place within the narrow confines of nozzle walls and the atomizing gas mixes more completely with the liquid.

While an internal mix nozzle does offer significant advantages in providing a narrowly collimated, finely atomized spray stream, it is found in practice that spraying resinous, coalescing materials, such as paints, frequently produces a non-uniform shearing of the liquid stream which, in turn, creates particles of a wide range of varying sizes in the atomizing chamber. Frequently, particles of sprayed material will coalesce within the nozzle walls or on the tip of the nozzle spray discharge orifice forming an excessive build-up which eventually results in "spitting" or "slugging" of partially dried "oversized" particles which can mar a finish.

In an attempt to overcome these particular disadvantages, internal-mix nozzles have been modified to include means for electrostatically charging the spray stream. Generally, a spray stream formed in an electrostatic field, especially that formed in an induction charging field, comprises mainly particles of uniformly small mean diameter. Electrostatically charging of spray stream particles provides additional advantages of improved uniformity of distribution of the particles, since the particles of like charge tend to distribute themselves evenly in a given space; electrostatic charging also provides improved efficiency of particle deposition since the charged particles are attracted to a target grounded or charged to an opposite polarity. Typically, the electrostatic charging means can take the form of induction charging means, such as an induction charging electrode disposed within the confines of an internal mix nozzle and adjacent to the atomization zone to achieve especially fine atomization at lower atomizing gas flow rates.

Examples of such induction-charging, internal-mixing spray devices are disclosed in U.S. Pat. No. 3,698,635 to J. E. Sickles and in U.S. Pat. No. 4,004,733 to S. E. Law. In each of these reference devices electrostatic charge is induced on particles of material as the particles are formed by a high velocity air stream coacting with a liquid material stream. In each of the reference devices, the same air stream is utilized firstly to atomize the material and then to entrain the material in a collimated stream of spray particles as the spray stream exits the confines of the spray nozzle.

Frequently, however, the use of internal-mixing devices having electrostatic charging means compounds the problem of spray particles tending to accumulate on the inner walls of the spray nozzle, at the spray discharge orifice and on the outer walls of the nozzle. When film-forming coating material particles collect on portions of the spray head nozzle, there tends to be formed agglomerates or "slugs" of partially dried material which subsequently break away from the nozzle, are pulled into the spray stream and deposited upon a target substrate. Particularly in paint application this "slugging" phenomenon precludes the formation of smooth, glossy films. The problem is especially acute in devices having induction charging electrodes which charge particles of a polarity opposite that of the electrode. In such devices the exterior surfaces of the dielectric shields, which are in intimate contact with the high voltage electrode and serve to insulate the electrode from the environment, take on a charge opposite that of the charged particles so that particles exiting the spray stream discharge port are likely to be attracted to, and deposit upon, the outer surfaces of the spray nozzle.

There are further detrimental effects which result from liquid material collection on the dielectric surfaces adjacent to the electrode, particularly when the atomized liquid exhibits some conductivity. Firstly, a conductive liquid because of electrical contact with the electrode extends the effective area of the electrode within the atomization chamber. This effect would improve charging efficiency if the electrode is too small or placed in an inferior position for maximum particle charging, that is, if the upstream or rearward termination of the electrode is forward of the downstream, or forward extent of the liquid nozzle as, for example, shown in U.S. Pat. No. 4,004,733 to Law. Secondly, if the material extends forwardly of the electrode, perhaps even around to the front of the nozzle, more inductively charged particles, both inside and outside the chamber, are intercepted with a resulting increase in build-up of material and increased detrimental slugging. This condition produces the additional detrimental effects of requiring more current from the power supply to compensate for the oppositely charged particles which strike the "effective" electrode and to maintain the electrode at a given voltage. Thus, a bigger power supply is required. In addition, the deposition of this material may eventually clog up the nozzle requiring frequent and time consuming cleaning procedures.

SUMMARY OF THE INVENTION

The spray device of the present invention overcomes the aforementioned problems occurring in internal-atomizing nozzles both with and without induction charging means. The invention can be generally described as an internal-atomizing spray head for forming a liquid material into a spray stream of gas-atomized liquid particles, comprising means defining an atomizing chamber having end walls and side walls, liquid inlet means in the atomization chamber for receiving a stream of liquid material to be atomized, gas inlet means in the atomization chamber for receiving a stream of gas for mixing with the stream of liquid material to form a spray stream of liquid particles in a region within the atomization chamber, spray outlet means in the atomization chamber for discharge of a spray stream of gas-atomized liquid particles from the spray head, and gas outlet means disposed adjacent the spray outlet means for delivering a second stream of gas for coaction with a spray stream of gas-atomized liquid particles.

The spray device may be further characterized by its spray head having the liquid inlet means comprise an orifice in one end wall of the atomizing chamber, the gas inlet means comprise an annular orifice concentrically disposed about the orifice of the liquid inlet means, the spray outlet means comprise an orifice in another end wall of the atomizing chamber, and the gas outlet means comprise an annular orifice concentrically disposed about the orifice of the spray outlet means.

Within the atomization chamber there may also be charging means for forming electrostatically charged particles. Such charging means is typically of the induction charging type and comprises an electrode embedded in or forming a portion of a sidewall or being the sidewall of the atomization chamber and disposed radially outwardly of the axis of the atomization chamber. Usually the induction charging electrode extends forwardly and preferably, but not necessarily, rearwardly of the region within the atomization chamber in which the electrostatically charged particles are formed. One advantage that results from the induction charging electrode being located within the atomization chamber in close proximity to the liquid stream and to the region of particle formation is that low charging voltages provided by smaller, safer power sources may be utilized.

The gas outlet means disposed adjacent the spray outlet means mentioned above is typically an annular orifice, or an annulus, concentric with the spray outlet means which is usually a round orifice. The annulus delivers a stream of gas, such as a high velocity stream of atmospheric air from a pressurized source, that coacts with a spray stream of particles emanating from the spray outlet orifice. The secondary stream of gas emanating from this annulus operates to improve collimation of the spray particle stream which is formed in the atomization chamber, the particles of the spray stream being formed by a stream of liquid material coacting with a primary stream of air within the atomization chamber. Further collimation of coating material particles by the second annular column of gas is of significant advantage inasmuch as the particles are prevented from returning to the nozzle face; thus, the aforementioned slugging phenomenon is minimized.

The second stream of gas offers the further advantage of reatomizing any liquid coalescing on the spray nozzle orifice and nozzle outer walls from stray spray particles which deposit on the nozzle. This feature is particularly advantageous in devices having induction charging electrodes which charge particles with a polarity opposite that of the charge induced on the outer nozzle surfaces, which surfaces attract such oppositely charged particles. Apparently, the second stream of gas exerts an "aspirating" effect within the cavity where material build-up occurs in the spray outlet nozzle; rapid reatomization by the second stream operates to prevent liquid material from drying on the nozzle walls and thus minimizes large particle slugging.

An unexpected and surprising advantage provided by a spray device having a spray head with means for secondary atomization is the improvement in the uniformity of particle size of liquid material. A second stream of gas provided by the secondary atomizing means intersects and coacts with the spray particle stream to break up any large particles formed during the primary atomization step. This improvement in particle size uniformity is especially advantageous when spraying difficult to atomize liquids such as high solids organic systems which as a class atomize poorly.

The manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

DETAILED DESCRIPTION OF THE INVENTION

Figure 1:
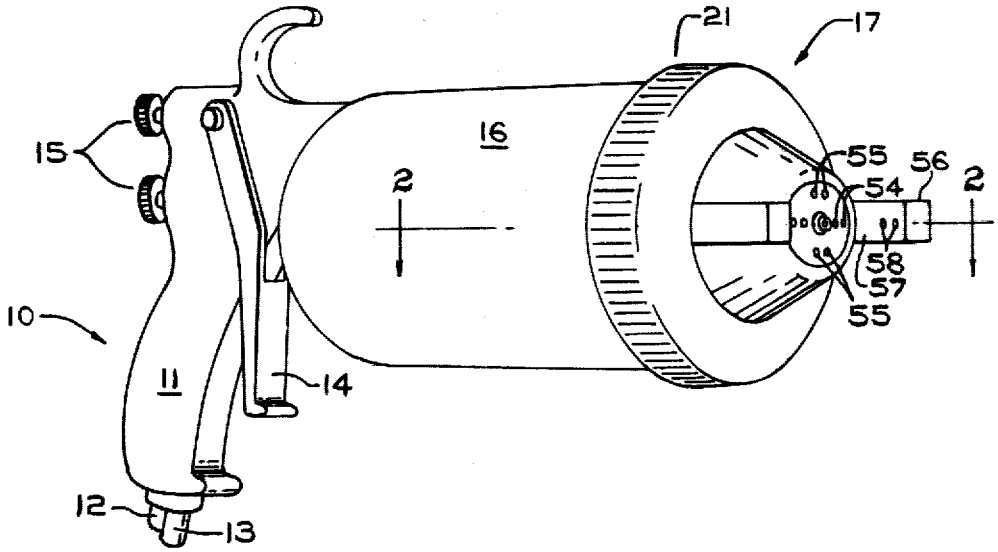
FIG. 1 is a perspective view of a conventional spray gun fitted with a spray head of the invention.

There is shown in FIG. 1 a conventional spray gun 10 having a handle or gripping means 11 with separate liquid material and air supply means shown as integrally attached feed hoses 12 and 13, respectively. Delivery of streams of liquid and air to the spray gun through feed hoses from remote sources of liquid material and compressed air (not shown) is controlled by trigger mechanism 14 and associated conventionally adjustable valving means 15 mounted at the "upstream" end of spray gun barrel 16 adjacent handle 11.

At the "downstream" end of spray gun barrel 16 is spray head assembly 17. Shown in detailed partial cross-section in FIGS. 2 and 3 is a spray head assembly 17 comprising generally a fluid delivery nozzle body 18, a spray stream discharge nozzle body, element 9 in FIG. 2 and 19 in FIG. 3, an air cap 20 and a threaded retainer nut 21.

Fluid delivery nozzle body 18 has an upstream portion 22 and an end (not shown) in operable connection with barrel 16. The fluid nozzle body 18 tapers from a mid portion forming a shoulder 23 which terminates at a narrower end portion 24. Shoulder 23 is in sealing contact with, respectively, spray stream discharge nozzle body 9 in FIG. 2 and 19 in FIG. 3. Centrally disposed upon downstream end 24 of fluid nozzle body 18 is a liquid delivery nozzle extension 25. Communicating upstream portion 22 with extension 25 is an axially located passageway 26 for delivering liquid material from feed hose 12 to an orifice 27, the liquid discharge port, formed at the end of nozzle extension 25. Passageways 28 between upstream portion 22 and downstream end portion 24 deliver air under pressure from feed hose 13 to a first plenum 29.

Figure 2:
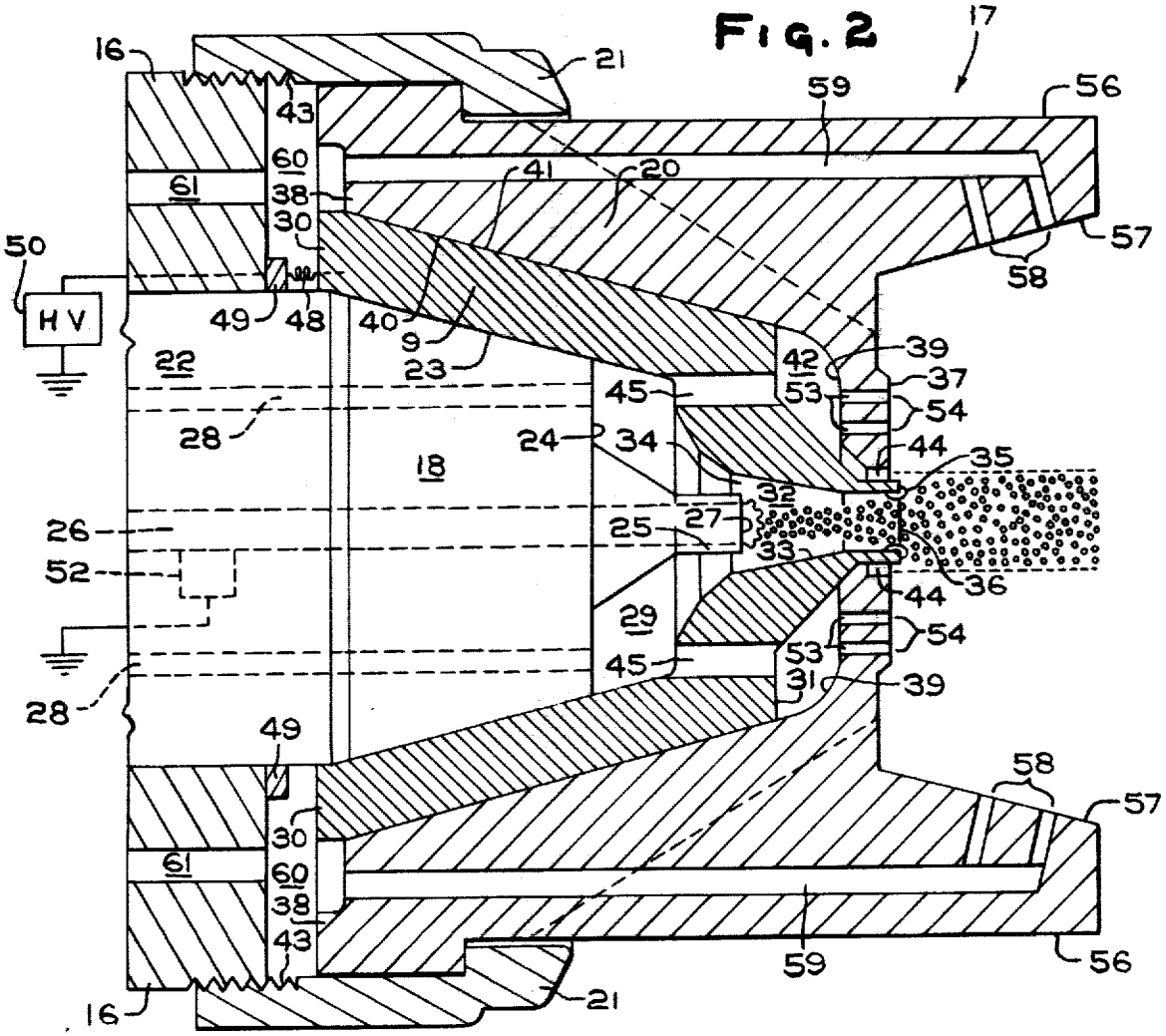
FIG. 2 is a partial sectional view of a top elevation of one embodiment of an electrostatic spray head like that shown in FIG. 1.
Figure 3:
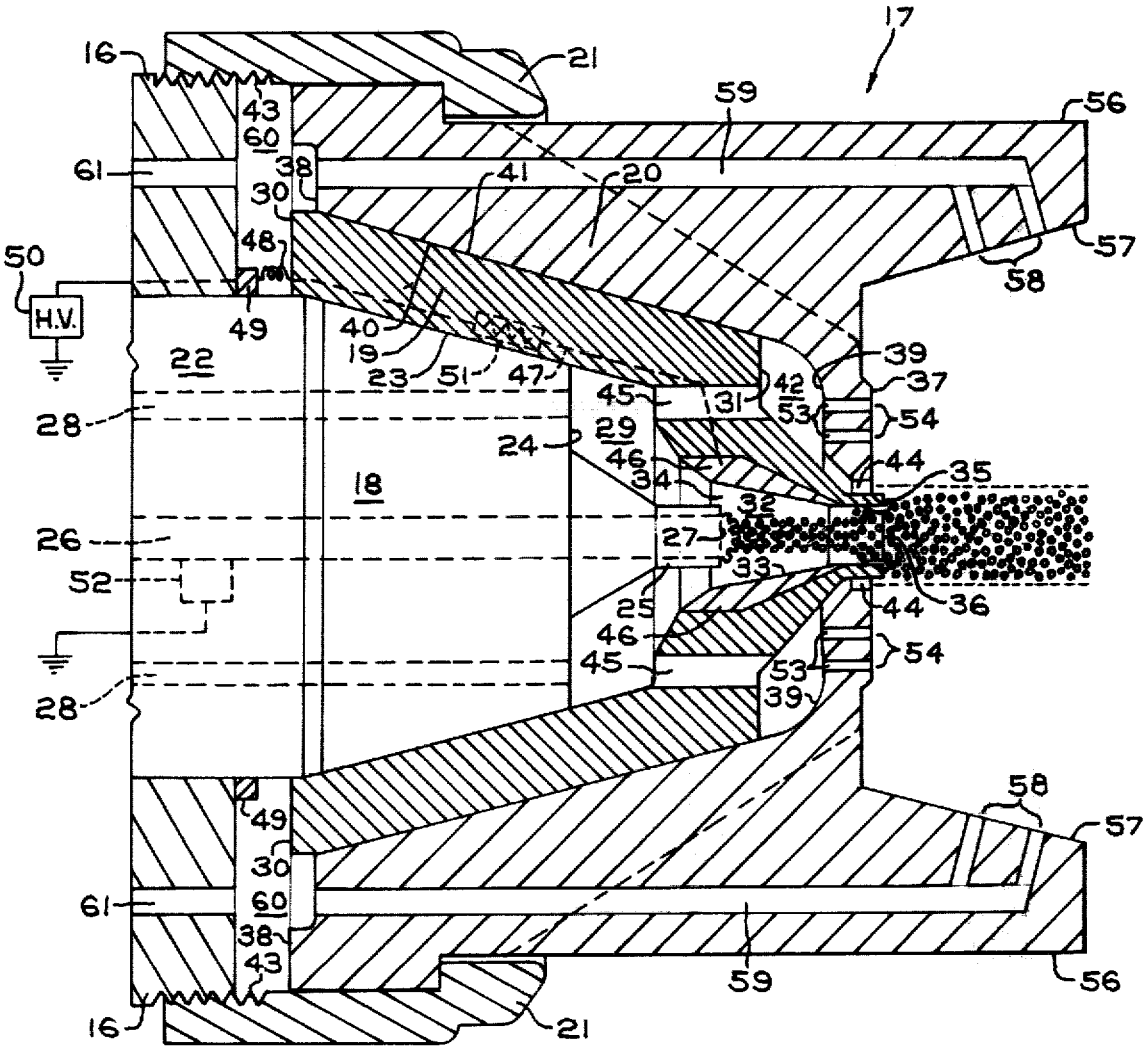
FIG. 3 is a partial sectional view of a top elevation of a second embodiment of a spray head like that shown in FIG. 1 equipped with induction charging means.

Spray stream discharge nozzle 9 in FIG. 2 and 19 in FIG. 3 comprises a generally hollow, frustum-like body portion with a wide-mouthed upstream end 30 and a narrower downstream end 31. Plenum 29 is formed by the space bounded by fluid delivery nozzle end 24 within the hollow interior of spray stream discharge nozzle body 19 at downstream end 31.

Within spray stream discharge nozzle end 31 is atomization chamber 32 having tapering sidewalls 33. Protruding into the upstream end of chamber 32 is liquid delivery nozzle extension 25, with orifice 27 forming both the liquid material outlet for liquid material delivery passageway 26 and liquid material inlet means for atomization chamber 32. The downstream end of cylindrical liquid delivery nozzle extension 25 is centrally disposed within the upstream opening of chamber 32 so that an annular orifice, or annulus, 34 is formed.

Annulus 34 is characterized as the "primary annulus," the function of which is to admit a stream of atomizing gas, such as air, into atomization chamber 32 from plenum 29. Compressed gas for plenum 29 is furnished through passageways 28 from a source (not shown) that delivers the gas to the spray gun by means of feed hose 13. In operation of the spray device, a stream of gas of annular cross-section enters atomization chamber 32 and coacts with the cylindrically-shaped stream of liquid material emanating from liquid discharge orifice 27. The impact of the relatively high velocity gas stream upon the relatively low velocity liquid stream creates on the surface of the liquid irregular discontinuities that form cusps of "liquid termini" extending outwardly from the liquid surface. The shearing force of the gas stream upon the liquid termini causes a portion of the liquid to separate from the main liquid stream into discrete particles.

At the downstream end of chamber 32 is a cylindrically-shaped nozzle extension 35 directed downstream from chamber 32 and terminating in outlet means comprising a discharge port 36 through which a spray stream of liquid particles may be discharged.

An air cap 20 has a downstream oriented, substantially planar face 37 and a tapered hollow interior portion formed between an upstream wide-mouthed open end 38 and a narrower downstream end 39. Nestled within the hollow interior portion of air cap 20 is the aforementioned frustum-shaped spray stream discharge nozzle body 19 which has its exterior sidewalls 40 tapered and in sealing contact with complementary tapering interior sidewalls 41 of air cap 20. Established within the interior of air cap 20 at downstream end 39 is a second plenum 42 formed in the space bounded by air cap downstream end 39 and exterior wall portions of the spray stream discharge nozzle end 31.

Spray head assembly 17, with, respectively, spray stream discharge nozzle body 9 in FIG. 2 and 19 in FIG. 3, nestled within air cap 20, is held in operative contact with fluid delivery nozzle body 18 by retainer nut 21. Complementary threaded portions 43 on retainer nut 21 and barrel 16 secure nut 21 and spray head assembly 17 to the spray gun.

Centrally disposed upon air cap face 37 is an orifice 44 of annular configuration formed by the cooperation of cylindrically-shaped spray nozzle extension 35 protruding through an opening in the wall of downstream end 39 of air cap 20. Annular orifice 44 constitutes a "secondary annulus" and provides the outlet means for a second stream of gas which impinges upon the stream of liquid spray particles emanating from discharge port 36. Compressed gas for forming the secondary stream is supplied from second plenum 42 which in turn is in communication via passageways 45 with the supply of compressed gas in first plenum 29. The illustrated embodiment shows first plenum 29 supplying air to second plenum 42 as a matter of convenience. Plenum 42 could be supplied through alternate passageways with a second gas from a source separate from that supplying plenum 29. In such arrangement, the stream of gas providing primary atomization could be distinctly different from the gas stream emanating from secondary annulus 44 in such physical characteristics as humidity and temperature, or in the kinds of gases employed, e.g., nitrogen and atmospheric air.

The second stream of gas provides further collimation of the spray particle stream discharged from port 36 by entraining the particles tending to scatter from the main stream. The span of time, and the distance from the nozzle face, that entrainment is effective depends upon the mass and volume size of the particles and the velocity of the gas stream emanating from secondary annulus 44. It is desirable, of course, that entrainment continue for a time and distance sufficient so that substantially all of the liquid particles are prevented from depositing upon the nozzle or upon other portions of air cap 20. Another advantage derived from the second stream of gas is that out-sized liquid particles formed in the atomization chamber 32 are further broken up into smaller particles by the shearing force of the secondary gas stream impinging upon the larger particles.

In the embodiment shown in FIG. 2, the spray stream discharge nozzle body 9 is constructed of a semi-conductive material such as Valox® (General Electric Co.) doped with graphite, while the fluid delivery nozzle body 18 and air cap 20 are constructed of dielectric material. Because the nozzle body 9 is semi-conductive, the sidewall 33 of the atomization chamber 32 becomes an annular induction charging integral electrode upon application of voltage to said nozzle body 9. The resulting sidewall electrode is disposed radially outwardly of the axis of atomization chamber 32 and extends upstream and downstream of orifice 27, about which orifice a charging region is defined wherein induction-charged gas-atomized particles are formed. A resilient, coil spring-like conductor 48 having an end portion thereof embedded in the nozzle body 9 connects the upstream end 30 of the nozzle body 9 to a conductive contact means in the shape of a ring 49 affixed to the barrel 16. The ring-shaped contact means permits operative electrical contact with coil spring conductor 48 to be made for delivering a high voltage electrical potential to nozzle body 9 irrespective of the rotational position of spray head 17 when mounted on barrel 16. A high voltage electrical potential source 50, which may be mounted on barrel 16 or handle 11 or at some location remote from the spray device, is shown diagrammatically and in electrical connection with contact ring 49. The semi-conductive property of the nozzle body 9 acts as a series resistance of high ohmic value between the high voltage source 50 and the resulting sidewall electrode.

The purpose of the resistance is to reduce the danger of arcing or sparking when deposits of conducting or moderately conducting spray materials build up within the gun. These deposits tend to reduce the distance between the electrode and the grounded liquid or tend to provide leakage paths from the electrode through the nozzle spray discharge port to a ground point. The resistance limits high current flow or surges of current to the electrode under short-circuit conditions created by the build-up of deposited spray materials. Thus, because of this resistance, insufficient charge travels, for example, to the tip of the spray nozzle extension 35 to create any arcing or sparking from said tip to a ground point. This absence of arcing or sparking eliminates the safety hazard of igniting any flammable vapor which may be present, depending on material being sprayed.

In the embodiment illustrated in FIG. 3, which shows a spray head equipped with a conductive annular electrode, it is preferred that the components of the spray head, namely, fluid delivery nozzle body 18, spray discharge nozzle body 19 and air cap 20, be fabricated of dielectric material. Spray head components of conductive material, in contacting the liquid stream or in contact with other means, can be easily grounded. Under such conditions the electric field intensity at the spray particle forming region is diminished; and, consequently, particles are formed within the charging region with a correspondingly diminished charge-to-mass ratio. Hence, it is appropriate that the spray head assembly, or at least the forward portion of fluid delivery nozzle body 18 forming nozzle extension 25, be constructed of dielectric material because of its proximity to the charging electrode.

Other components or portions of components could be constructed of conductive material provided, of course, that such conductive elements are "floating" with respect to the electrode and the grounded liquid stream.

As illustrated in FIG. 3, electrostatic induction charging means comprising an annular electrode 46 made of a conductive material, such as brass, copper or aluminum, forms a portion of the sidewall of atomization chamber 32. Other conductive materials may also be used for making electrode 46, such as the group of highly conductive plastic compositions sold under the trademark VELOSTAT® of 3M Company. Electrode 46 is disposed radially outwardly of the axis of atomization chamber 32 and extends upstream and downstream of orifice 27, about which orifice a charging region is defined wherein induction-charged gas-atomized particles are formed. Attached to electrode 46 and shown in diagrammatic form is conducting means 47, such as a wire embedded in spray stream discharge nozzle body 19. A resilient, coil spring-like conductor 48 connects conducting means 47 to a conductive contact means in the shape of a ring 49 affixed to barrel 16. The ring-shaped contact means permits operative electrical contact with coil spring conductor 48 to be made for delivering a high voltage electrical potential to electrode 46 irrespective of the rotational position of spray head 17 when mounted on barrel 16. A high voltage electrical potential source 50, which may be mounted on barrel 16 or handle 11 or at some location remote from the spray device, is shown diagrammatically and in electrical connection with contact ring 49.

In some instances it may be desirable to insert a series resistance 51 of high ohmic value between the high voltage source and induction charging electrode 46, such as that discussed in U.S. Pat. No. 3,698,635 to James E. Sickles. The purpose of the series resistance is to reduce the danger of arcing or sparking when deposits of conducting or moderately conducting spray materials build up within the gun. These deposits tend to reduce the distance between the electrode and the grounded liquid or tend to provide leakage paths from the electrode through the nozzle spray discharge port to a ground point. The series resistance limits high current flow or surges of current to the electrode under short-circuit conditions created by the build-up of deposited spray materials.

In each of the embodiments of FIGS. 2 and 3, a charging zone is established between the electrode of the induction charging means and the liquid stream by the application of a voltage potential at the electrode from the high voltage power supply. An electric field is thus defined extending from the surfaces of the electrode to the liquid stream at liquid discharge port 27.

The liquid stream itself is grounded either at the source or by a grounding head 52 as shown, relative to the electric potential applied to the electrode. Spacing of the electrode in relation to liquid discharge port 27 is somewhat critical inasmuch as the spray particles formed in the charging region about port 27 should be confined by the high velocity stream of gas emanating from the primary annulus so that substantially all the charged particles pass through a region of the charging zone spaced apart from the electrode. In this manner, the particles of the spray stream, which bear electric charge of polarity opposite that of the charging electrode, are substantially prevented from contacting the electrode. As the induction charging electrode is moved radially outwardly from the axis of the liquid flow, higher voltages are required to achieve optimum charging efficiency. It would be detrimental to performance, however, if the induction charging electrode is sufficiently small or has sharp edges or the voltage is sufficiently high, to produce corona discharge. It has been found that optimum results are obtained when the average potential gradient within the charging zone, between the charging electrode and the liquid nozzle orifice, is in the range of 50,000 volts per inch to 500,000 volts per inch; preferably, the average voltage gradient to be used falls in the range of 150,000 to 300,000 volts per inch. For the devices shown in the drawings, it has been found that applied voltages in the range of 2,000 to 10,000 volts between the electrode and a grounded liquid stream provide the aforementioned voltage gradients.

With induction charging devices such as those utilized in the present invention, liquid coating material atomization and electric charge imposition occur substantially simultaneously so as to create a stream of discrete particles bearing an induced electric charge. For example, the stream of liquid coating material which passes through port 27 of liquid nozzle extension 25 is thrust into contact with a flow of air or gas from concentrically disposed annular port 34, the primary annulus, which flow of gas or air impinges upon and mixes with the liquid stream and tends to distort the stream into an irregular configuration comprising surface discontinuities as described before. Formation of cusp-like, liquid stream discontinuities or "liquid termini" is aided by the high intensity electric field existing between the high voltage electrode and the grounded liquid stream. The electric field flux lines tend to concentrate at the sharp-pointed liquid termini and to induce electric charge redistribution within the liquid stream, with charge of sign opposite that of the high voltage electrode migrating to the extreme sharp portions of the liquid termini. Since the charges on the liquid termini and on the electrode are opposite in polarity, electrical attractive forces cooperate with the mechanical distresses furnished by the flow of gas or air to separate the liquid termini from the liquid stream so as to form discrete particles bearing electric charge.

Thus, the described induction charging means and potential applying means of devices employed in the present invention cooperate to establish a region in an electric field within a charging zone in which spray particles become charged by induction of charges on the particles as the particles are formed by the spray particle forming means.

In typical prior art internal-mixing induction-charging spray devices having an electrode embedded in a nozzle fabricated of dielectric material, an electric field is established within the dielectric material when a high voltage is applied to the electrode. This electric field tends to cause a charge of polarity opposite that of the spray particles to be established on the exterior surfaces of the downstream end of the nozzle remote from the electrode, which surfaces are thus attractive to induction charged spray particles. In a spray device of the invention having a secondary annulus, as illustrated in FIGS. 1–3, a secondary gas stream interrupts the dielectric path that tends to be formed between the electrode and air cap face 37. Thus a much lower electric potential is established at air cap face 37 which, in turn, minimizes the particle attracting phenomena.

Furthermore, the relatively high velocity air stream of annular configuration emanating from annulus 44 isolates the tip of nozzle extension 35 from air cap face 37. Thus, there is prevented any particle accumulation which might otherwise create a conductive path from the electrode outwardly through nozzle extension 35 to air cap face 37. A conductive path would, of course, establish the exterior portions of the spray head as particle attracting surfaces.

Moreover, since the spray stream is substantially comprised of particles of like polarity, there is, in addition to the usual mechanical expansion and diffusion forces acting on the particles of the spray stream, a tendency for the particles of the spray stream to diverge because of the mutual repulsion of the electrically charged particles. A second stream of gas from secondary annulus 44 substantially prevents such charged particles from diverging from the stream and depositing upon air cap face 37 by entraining any stray spray particles in a direction parallel to the collimated stream established by primary annulus 34. This entrainment continues for a distance from the nozzle sufficient that the electric field attractive forces between the spray head and the particles, already greatly diminished by the effect of the secondary annulus on the aforementioned dielectric and conductive paths, are further diminished.

The electrostatic devices illustrated in FIGS. 1–3 offer the convenience and versatility of spraying both organic and water-based film-forming materials. These materials include pigmented and non-pigmented polymer compositions in liquid form and pesticides. A chief advantage provided by the spray devices of the invention in spraying the aforementioned liquid compositions is the avoidance of the detrimental build-up of material upon the nozzle. As illustrated in FIGS. 2 and 3, particles at the fringe of the spray stream tend to fall out from the stream near spray discharge port 36 and deposit as a film on the tip of nozzle extension 35. The film build-up is illustrated in an exaggerated condition at port 36 to illustrate the portions of the nozzle prone to experience material build-up. Secondary annulus 44 provides a second stream of gas of annular configuration, as shown diagrammatically in FIGS. 2 and 3, which exerts the aforementioned secondary atomization and aspirating effects and thus minimizes film build-up on portions of the nozzle walls.

As illustrated in both FIGS. 2 and 3, there are provided additional means for forming the spray stream of gas-atomized particles into a fan configuration. Passageways 53 communicate plenum 42 with orifices or ports 54 in face 37 of air cap 20, which ports are disposed radially outwardly of the axis of the spray outlet means 35 and 36. Streams of relatively high velocity air or other gas formed from the pressurized supply contained in plenum 42 and discharged from ports 54 serve to form the collimated spray stream into a fan configuration. As shown in FIG. 1, additional sets of ports 55 are located on air cap face 37 at either side of the nozzle extension 35. These ports provide streams of air or other gas from passageways (not shown) supplied by plenum 42, which gas streams also aid in forming the spray stream into a fan configuration.

Also illustrated in FIGS. 1–3 are means for altering the shape of the spray stream fan configuration, which means comprises horns 56 integrally formed with air cap 20 and positioned radially outwardly of the axis of spray outlet means 35 and 36. Horns 56 extend downstream from air cap face 37 and have inner faces 57 oriented toward the spray stream outlet means axis. Upon faces 57 are disposed ports 58 through which relatively high velocity streams of air or other gas pass to impinge upon and alter the shape of the spray stream fan configuration. Fan shaping ports 58 are in communication via passageways 59 with a third plenum 60. Air or other gas is supplied to plenum 60 from passageways 61 within barrel 16, which supply of gas or air may be from the same source (not shown) which feeds first plenum 29 through feed hose 13.

It should be pointed out that for the sake of simplicity the effects of the fan-forming and fan-shaping gas streams upon the spray particle stream have not been illustrated. The configuration of the spray stream would, of course, depend upon the relative velocities of gas streams emanating from ports 54 and 58 with respect to each other and with respect to the velocity of the spray particle stream.

From the foregoing description taken with the accompanying drawings, it will be apparent that this invention provides a spray head with a secondary annulus, useful in the electrostatic application of sprayable liquid materials, which yields improved liquid material atomization and deposition efficiency.

Those skilled in the art will appreciate that the invention can be embodied in forms other than as herein disclosed for purposes of illustration.

The invention is defined by the following claims.

What is claimed is:

1. A spray head of the internal-atomizing type adaptable for use on induction charging air-atomization spray apparatus suitable for applying a spray stream of particles of liquid material to a substrate, comprising:

a fluid delivery nozzle body having upstream and downstream ends and having passageways for transferring under pressure separate streams of air and of liquid material between said upstream and downstream ends;

means for operatively connecting the upstream ends of the passageways of said fluid delivery nozzle body to separate sources of air and of liquid material;

a spray stream discharge nozzle body comprising a generally hollow frustum-like portion with a wide-mouthed upstream end in which said fluid delivery nozzle body is nested and a narrower downstream end;

an air cap body having a downstream-oriented substantially planar exterior face and having a hollow interior portion between an upstream wide-mouthed open end and a narrower downstream end, in which said hollow portion of said spray stream discharge nozzle body is nested;

an orifice in the narrower downstream end of the hollow portion of said air cap body;

a spray stream discharge nozzle extension protruding downstream from the downstream end of said spray stream discharge nozzle body, said nozzle extension terminating in a spray stream discharge port;

an atomization chamber within said spray stream discharge nozzle body having an upstream inlet for receiving a stream of liquid material and having a downstream outlet orifice in communication with the passageway of said spray stream discharge nozzle extension;

a liquid stream delivery nozzle extension downstream from the downstream end of said fluid delivery nozzle body, said nozzle extension being of dielectric material and having an outlet orifice in communication with the upstream end of said atomization chamber for delivery of a stream of liquid material into said atomization chamber;

a first annular orifice in said atomization chamber inlet for delivering a stream of atomizing air for mixing with a stream of liquid material, said orifice defined by a downstream portion of the liquid delivery nozzle extension and the atomization chamber inlet;

induction charging means in said atomization chamber connectable to a direct current high voltage source for inducing electrostatic charge upon air-atomized particles formed from a stream of liquid material as said particles are formed; and a second annular orifice for delivering a stream of atomizing air for mixing with said spray stream of atomized liquid material discharged from the spray stream discharge port, said second annular orifice defined by a portion of the downstream end of the spray stream nozzle extension and said air cap body orifice.

2. The spray head of claim 1, further comprising means for connecting said spray head to a spray gun body having valving means for controlling the flow rates of streams of air and liquid material delivered to said spray head and having means for connecting power supply means for delivering direct current voltage to the induction charging means of said spray head.

3. The spray head of claim 1 wherein the induction charging means comprises the sidewall of the atomization chamber, said sidewall being formed by the downstream end of the spray stream discharge nozzle body and fabricated of a semi-conductive material.

4. The spray head of claim 3 wherein the fluid nozzle delivery body and the air cap body are fabricated of a dielectric material.

5. The spray head of claim 3 wherein said fluid delivery nozzle body further includes means for connecting a stream of liquid material to electrical ground relative to said induction charging means.

6. The spray head of claim 1 wherein the induction charging means comprises an electrode fabricated of a material selected from the group consisting of highly conductive metals and highly conductive plastic compositions and secured to at least a portion of the sidewall of said atomization chamber.

7. The spray head of claim 6 wherein said induction charging means further comprises a series resistance between said electrode and said means for connecting power supply means.

8. The spray head of claim 6 wherein said fluid delivery nozzle body is fabricated of a dielectric material.

9. The spray head of claim 6 wherein said fluid delivery nozzle body further includes means for connecting a stream of liquid material to electrical ground relative to said induction charging electrode.

10. The spray head of claim 1 further comprising means for forming the spray stream of gas-atomized particles into a fan configuration, and further comprising means for altering the shape of the fan configuration of the spray stream, said fan-forming means comprising at least one orifice for discharge of a stream of air, said orifice disposed radially outwardly of said secondary annular orifice on said air cap body exterior face, said fan-shaping means comprising at least two air horns extending downstream from said air cap body and having at least one orifice on each air horn for discharge of streams of air, said orifices disposed on the face of each air horn oriented toward the axis of said spray stream discharge port.

11. A process for forming liquid material into a spray stream of gas-atomized particles, which process employs an atomization chamber including (i) upstream and downstream ends and sidewalls, (ii) liquid inlet means of dielectric material comprising an orifice in said upstream end of said atomization chamber, (iii) gas inlet means comprising a first annular orifice concentrically disposed about said orifice of said liquid inlet means, and (iv) spray outlet means comprising an orifice at said downstream end of said atomization chamber and having an axis, said process comprising the steps of:

(1) delivering a stream of liquid material through said liquid inlet means into a region of said atomization chamber, (2) delivering a first stream of gas through said gas inlet means into said region of said atomization chamber, (3) atomizing said liquid material by the coaction of said first gas stream which has a relatively high velocity with said stream of liquid material which has a relatively low velocity, to form gas-atomized particles within said region of said atomization chamber;

(4) inducing electrostatic charge upon said gas atomized particles as said particles are formed within said region of said atomization chamber, (5) confining said gas-atomized particles in a stream as said particles are thrust from said atomization chamber in a spray, (6) delivering a second stream of gas through a second annular orifice concentrically disposed about said orifice of said spray outlet means and into contact with said spray to provide further atomization of gas-atomized particles.

12. The process of claim 11 further comprising forming said spray into a fan configuration and altering the shape of said fan configuration of said spray with fan-forming means and fan-shaping means disposed radially outwardly of said axis of said spray outlet means.

* * * * *